US011180984B2

(12) United States Patent
Dirksen et al.

(10) Patent No.: US 11,180,984 B2
(45) Date of Patent: Nov. 23, 2021

(54) DRILLING METHODS AND SYSTEMS WITH AUTOMATED WAYPOINT OR BOREHOLE PATH UPDATES BASED ON SURVEY DATA CORRECTIONS

(71) Applicant: HALLIBURTON ENERGY SERVICES, INC., Houston, TX (US)

(72) Inventors: Ronald Johannes Dirksen, Spring, TX (US); Ian David Campbell Mitchell, Spring, TX (US); Jon Troy Gosney, Bellville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 456 days.

(21) Appl. No.: 14/910,587

(22) PCT Filed: Jul. 31, 2014

(86) PCT No.: PCT/US2014/049252

§ 371 (c)(1),
(2) Date: Feb. 5, 2016

(87) PCT Pub. No.: WO2015/026502

PCT Pub. Date: Feb. 26, 2015

(65) Prior Publication Data

US 2016/0201449 A1 Jul. 14, 2016

Related U.S. Application Data

(60) Provisional application No. 61/868,975, filed on Aug. 22, 2013.

(51) Int. Cl.
*E21B 47/024* (2006.01)
*E21B 7/04* (2006.01)
(Continued)

(52) U.S. Cl.
CPC ..... *E21B 47/024* (2013.01); *E21B 7/04* (2013.01); *E21B 7/10* (2013.01); *E21B 44/00* (2013.01)

(58) Field of Classification Search
CPC ..... G06F 11/00; G01V 3/38; E21B 44/00
See application file for complete search history.

(56) References Cited

U.S. PATENT DOCUMENTS 4,819,336 A 4/1989 Russell
5,230,387 A 7/1993 Waters et al.
(Continued)

FOREIGN PATENT DOCUMENTS

RU 82759 5/2009
WO 2008/103487 8/2008
(Continued)

OTHER PUBLICATIONS

Reay, et al., Improving directional drilling accuracy using magnetic referencing techniques, DEVEX 2012, http://nora.nerc.ac.uk/18437/1/Reay_etal_DEVEX2012_IIFR.pdf.*
Thorogood, J. L. (Dec. 1, 1990). Instrument Performance Models and Their Application to Directional Surveying Operations. Society of Petroleum Engineers. doi:10.2118/18051-PA(Year: 1990).*
(Continued)

*Primary Examiner* — Alia Sabur
(74) *Attorney, Agent, or Firm* — Benjamin Ford; Parker Justiss, P.C.

(57) ABSTRACT

A drilling method includes collecting survey data at a drilling site, and determining a waypoint or borehole path based on the survey data. The drilling method also includes sending the survey data to a remote monitoring facility that applies corrections to the survey data. The drilling method
(Continued)

also includes receiving the corrected survey data, and automatically updating the waypoint or borehole path based on the corrected survey data.

23 Claims, 4 Drawing Sheets

(51) Int. Cl.
*E21B 7/10* (2006.01)
*E21B 44/00* (2006.01)

(56) References Cited

U.S. PATENT DOCUMENTS

| | | | | |
|---|---|---|---|---|
| 5,806,194 | A | 9/1998 | Rodney et al. | |
| 6,021,577 | A | 2/2000 | Shiells et al. | |
| 6,321,456 | B1 | 11/2001 | McElhinney | |
| 8,180,571 | B2 | 5/2012 | Holmes | |
| 2008/0275648 | A1* | 11/2008 | Illfelder | E21B 47/022 702/7 |
| 2009/0090555 | A1* | 4/2009 | Boone | E21B 44/02 175/45 |
| 2010/0211318 | A1* | 8/2010 | Brooks | G01V 11/00 702/9 |
| 2010/0250207 | A1 | 9/2010 | Rodney | |
| 2010/0282508 | A1 | 11/2010 | Johnston | |
| 2010/0332175 | A1* | 12/2010 | Marsh | G01V 3/18 702/104 |
| 2011/0031015 | A1* | 2/2011 | Downton | H04L 67/025 175/27 |
| 2011/0213601 | A1 | 9/2011 | Pirovolou | |
| 2013/0228374 | A1* | 9/2013 | Chapman | E21B 44/00 175/24 |
| 2014/0244176 | A1* | 8/2014 | Hanak | G06F 11/00 702/9 |

FOREIGN PATENT DOCUMENTS

| | | |
|---|---|---|
| WO | 2009/039448 | 3/2009 |
| WO | 2015/026502 | 2/2015 |

OTHER PUBLICATIONS

"CA Examination Report", Nov. 15, 2016, Appl No. 2,919,764, "Drilling Methods and Systems with Automated Waypoint or Borehole Path Updates Based on Survey Data Corrections," Filed Jul. 31, 2014, 3 pgs.

"CN Office Action", Oct. 28, 2016, Appl No. 201480042707.7, "Drilling Methods and Systems with Automated Waypoint or Borehole Path Updates Based on Survey Data Corrections," Filed Jul. 31, 2014, 16 pgs.

"RU Office Action", Oct. 7, 2016, Appl No. 2016103111, "Drilling Methods and Systems with Automated Waypoint or Borehole Path Updates Based on Survey Data Corrections," Filed Jul. 31, 2014, 13 pgs.

Booth, J.E, "Real-Time Drilling Operations Centers: A History of Functionality and Organizational Purpose—The Second Generation", Booth, J.E, Real-Time Drilling Operations Centers: A History of Functionality and Organizational Purpose—The Second Generation, Copyright 2010, Society of Petroleum Engineers SPE 126017, 10 pgs.

Isachenko, V. K., "Wells Survey", Moscow, "Nedra", 1987, c. 185-191 or 205-212, 14 pgs.

McCann, Andrew et al., "Statoil's First Onshore Support Center: The Result of New Work Processes and Technology Developed to Exploit Real-Time Data", McCann, Andrew et al., Statoil's First Onshore Support Center: The Result of New Work Processes and Technology Developed to Exploit Real-Time Data, Copyright 20004, Society of Petroleum Engineers Inc., SPE 90367, 5 pgs.

PCT International Search Report and Written Opinion, dated Nov. 6, 2014, Appl No. PCT/US2014/049252, "Drilling Methods and Systems with Automated Waypoint or Borehole Path Updates Based on Survey Data Corrections," Filed Jul. 31, 2014, 16 pgs.

* cited by examiner

DRILLING METHODS AND SYSTEMS WITH AUTOMATED WAYPOINT OR BOREHOLE PATH UPDATES BASED ON SURVEY DATA CORRECTIONS

CROSS-REFERENCE TO RELATED APPLICATIONS

This application claims priority to U.S. Provisional Application No. 61/868,975, entitled "Real Time Survey Corrections," filed Aug. 22, 2013, and incorporated herein by reference as is in its entirety.

BACKGROUND

Many drilling programs involve concurrent drilling of multiple boreholes in a given formation. As such drilling programs increase the depth and horizontal reach of such boreholes, there is an increased risk that such boreholes may stray from their intended trajectories and, in some cases, collide or end up with such poor placements that one or more of the boreholes must be abandoned. Measurement-while-drilling (MWD) survey techniques can provide information to guide such drilling efforts. However, MWD survey data can suffer from inaccuracies at least due to earth's varying gravity and magnetic field. This is a particular issue at high geographic latitudes, where the inaccuracies increase significantly.

Earth's gravity, denoted by g, refers to the attractive force that the earth exerts on objects near its surface. The strength of Earth's gravity varies with latitude, altitude, and local topography and geology. For most purposes the gravitational force is assumed to act in a line directly towards a point at the centre of the Earth, but for very precise work the direction is known to vary slightly because the Earth is not a perfectly uniform sphere. Many modem electronic survey instruments can compensate for variations in gravity provided that the correct geographical location is entered into the tool software prior to commencement of the surveying process.

The Earth's magnetic field (or geomagnetic field) is an ever-changing phenomenon. It changes from place to place, and varies on time scales ranging from seconds to decades to eons. The most important geomagnetic sources include: the Earth's conductive, fluid outer core which accounts for approximately 97% of the total field, magnetized rocks in Earth's crust (crustal anomalies), and the disturbance field caused by electrical currents in the ionosphere and magnetosphere that induce magnetic fields within the oceans and the Earth's crust.

Existing efforts to improve MWD survey accuracy by accounting for earth's varying gravity, earth's varying magnetic field, and/or other parameters involve manual entry of data at each drilling site and/or at a remote location (e.g., emails or text messages are exchanged and updates are then manually entered into control software, etc.) to support suitable corrections for MWD survey data. Such efforts may cause drilling delays and they are subject to human error.

BRIEF DESCRIPTION OF THE DRAWINGS

Accordingly, there are disclosed in the drawings and the following description various drilling methods and systems with automated waypoint or borehole path updates based on survey data corrections. In the drawings.

Figure 1:
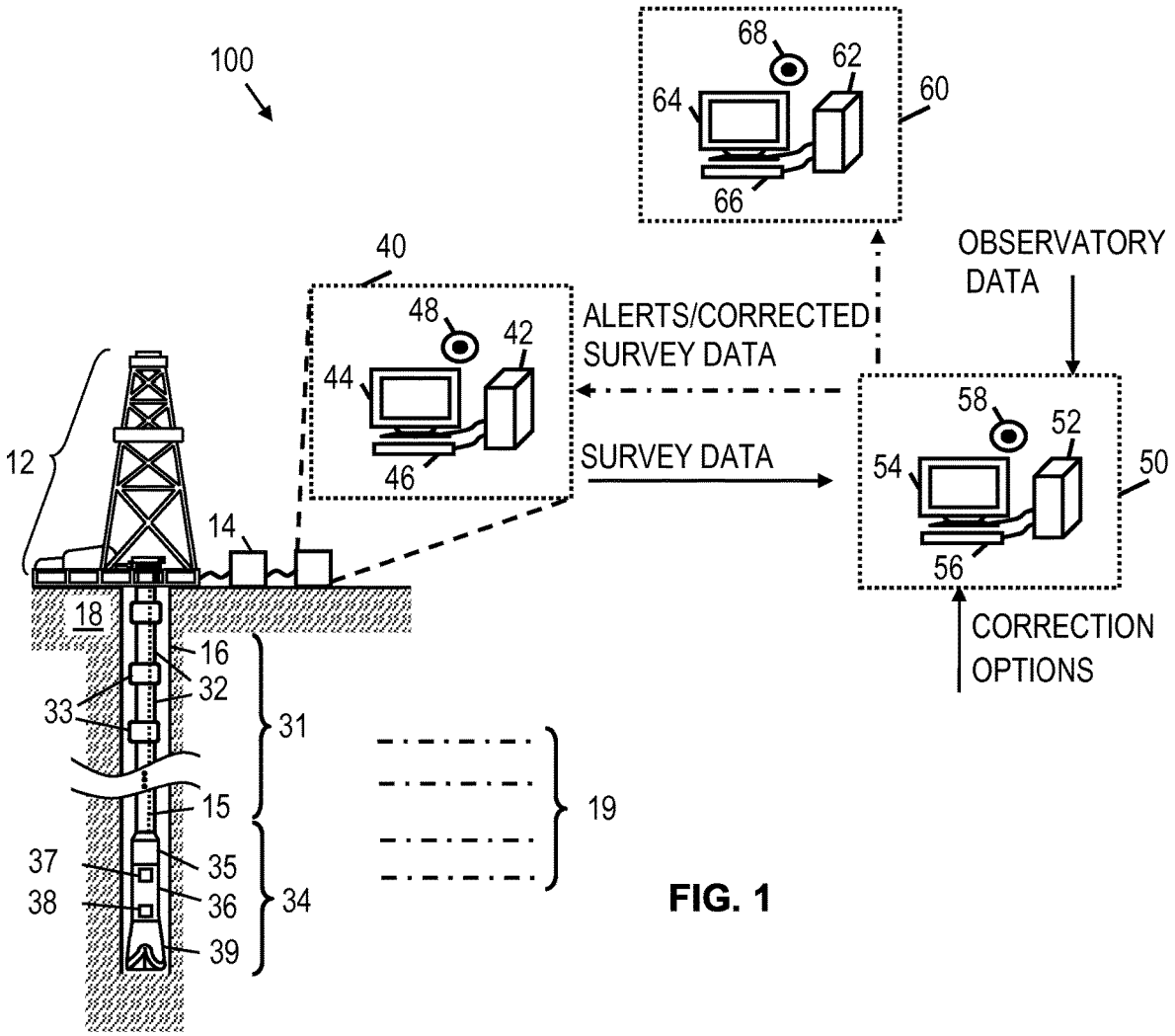
FIG. 1 is a schematic diagram showing an illustrative drilling system.

It should be understood, however, that the specific embodiments given in the drawings and detailed description do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are various drilling methods and systems with automated waypoint or borehole path updates based on survey data corrections. In an example method, survey data is collected at a drilling site. A waypoint or borehole path based on the survey data is determined. The survey data is sent to a remote monitoring facility that applies corrections to the survey data. (The remote monitoring facility may be a central facility that processes and integrates such information from many drilling sites as well as regional sensing stations that track variations in gravitational and magnetic fields, such integrated processing yielding better corrections for the survey data from all such drilling sites.) The corrected survey data is received at the drilling site, and the waypoint or borehole path is automatically updated based on the corrected survey data. The updated waypoint or borehole path may be used to manually or automatically adjust a drilling trajectory. Note: if the survey data sent to the remote monitoring facility is within specified limits, then corrected survey data need not be returned to the drilling site. Alternatively, a notification may be sent to the drilling site that the survey data is within the specified limits. Regardless of whether a notification is sent or not, the waypoint or borehole path need not be updated if the survey data is within the specified limits.

In at least some embodiments, data transfers between the drilling site and the remote monitoring facility are automatic. In such case, alerts may be used to notify drilling site personnel of particular events (e.g., when a change in waypoint or borehole path occurs) without providing an interface for making or accepting changes. In alternative embodiments, even with automatic data transfers, a drilling site operator maintains some control and can, for examples, reject or undo a correction. In such case, a notification may be sent back to the remote monitoring facility (to notify a survey manager that the correction was rejected or undone).

FIG. 1 shows an illustrative drilling system 100. In FIG. 1, a drilling assembly 12 enables a drill string 31 to be lowered and raised in a borehole 16 that penetrates formations 19 of the earth 18. The drill string 31 is formed, for example, from a modular set of drill pipe segments 32 and adaptors 33. At the lower end of the drill string 31, a bottomhole assembly 34 with a drill bit 39 removes material from formations 19 using known drilling techniques. The bottomhole assembly 34 also includes a survey tool 36 (e.g, a LWD or MWD tool string) to collect formation properties utilizing sources/transmitters 37 and/or sensors/receivers 38. As an example, the survey tool 36 may include sensors/receivers 38 and/or sources/transmitters 37 corresponding to one or more of a resistivity logging tool, an acoustic logging tool, a gamma ray logging tool, a nuclear magnetic resonance (NMR) logging tool, a passive ranging tool, and/or other logging tools. Further, the survey tool 36 may include sensors/receivers 38 to collect "raw" survey data such as time, depth, gravitational field components ($G_x$, $G_y$, $G_z$), magnetic field components ($B_x$, $B_y$, $B_z$), inertial/gyroscopic tracking, and any other such information from which tool position and orientation may be determined. Hereafter and throughout the specification, the term "survey data" refers to raw survey data and possibly formation properties collected by one or more survey tools.

The survey data may be collected while the survey tool 36 is moving or stationary. Further, in different embodiments, the survey tool 36 may include one or more anchors or extension mechanisms to stabilize or position the survey tool 36 (including sensors 38 or sources 37) in the borehole 16 while survey data is collected for a waypoint determination. Regardless of the particular manner in which the survey data is collected by the survey tool 36, the survey data collected by the survey tool 36 is conveyed to earth's surface for analysis at the drilling site and/or at a remote monitoring facility. For example, the survey data may be analyzed to determine properties of formations 19, to guide drilling in relation to the formations 19, and/or to guide drilling in relation to other existing or planned boreholes. In some cases, multiple boreholes in a region (corresponding to different wells) are concurrently drilled and the survey data collected for each borehole is used to guide concurrent borehole drilling operations.

The survey tool 36 may also include electronics for data storage, comnmnication, etc. The survey data obtained by the sensors/receivers 38 are conveyed to earth's surface and/or are stored by the survey tool 36. In FIG. 1, an optional cable 15 (represented by the dashed line extending between the bottomhole assembly 34 and earth's surface) is represented. The cable 15 may take different forms and includes embedded electrical conductors and/or optical waveguides (e.g., fibers) to enable transfer of power and/or communications between the bottomhole assembly 34 and earth's surface. The cable 15 may be integrated with, attached to, or inside components of the drill string 31 (e.g., IntelliPipe sections may be used). In at least some embodiments, cable 15 may be supplemented by or replaced at least in part by mud based telemetry or other wireless communication techniques (e.g., electromagnetic, acoustic). Another drilling option involves coiled tubing instead of drill pipe sections.

In FIG. 1, an interface 14 at earth's surface receives the survey data via cable 15 or another telemetry channel and conveys the survey data to a computer system 40, which may perform survey data analysis and drilling control operations as described herein. In at least some embodiments, the computer system 40 includes a processing unit 42 that performs survey data analysis and drilling control operations by executing software or instructions obtained from a local or remote non-transitory computer-readable medium 48. The computer system 40 also may include input device(s) 46 (e.g., a keyboard, mouse, touchpad, etc.) and output device(s) 44 (e.g., a monitor, printer, etc.). Such input device(s) 46 and/or output device(s) 44 provide a user interface that enables an operator to interact with the bottom/ole assembly 34 and/or with software executed by the processing unit 42. For example, the computer system 40 may enable an operator to select survey options, to view survey results, to view alerts and/or corrected survey results, to view or select a waypoint and/or borehole path, to direct drilling operations based on the survey results or corrected survey results, and/or to perform other operations. While not required, the computer system 40 may automate at least some survey analysis steps and/or drilling control steps. Additionally or alternatively, the computer system 40 may provide an interface that expedites survey analysis and drilling control by displaying acceptance prompts, alert notification, and/or selectable options related to survey analysis results, waypoints, a borehole path, andlor drilling adjustments. Such acceptance prompts or selectable options may include real-time information, historical information (e.g., acceptable drilling limits), corrected survey data, uncertainty values, and/or other information to assist an operator decision-making.

In at least some embodiments, the computer system 40 receives survey data from the survey tool 36, and determines a waypoint or borehole path (optionally in the form of a waypoint sequence) based on the survey data. The computer system 40 also sends the survey data to a remte computer system 50, which applies corrections to the survey data. Corrected survey data is later received by the computer system 40. The corrected survey data is used by the computer system 40, for example, to automatically update one or more waypoints or a borehole path. A drilling trajectory may then be manually or automatically adjusted using the updated waypoints or borehole path. While involvement of an operator is not required to update waypoints or a borehole path, an acceptance prompt or alert may be displayed to an operator when a waypoint or borehole path is updated based on the corrected survey data. In such case, an operator may accept the proposed waypoint or borehole path updates, reject the proposed waypoint or borehole path updates, or modify the proposed waypoint or borehole path updates. Even if a waypoint or borehole path is updated based on the corrected survey data without operator involvement, the operator may still direct drilling trajectory adjustments that are needed based on the adjusted waypoint or borehole path. Further, the alert or message related to corrected survey data may include a survey tool replacement indicator ("replace survey tool immediately", "replace survey tool after next run", etc) resulting from an automated and/or survey expert determination that the quality of the survey data is below a threshold level.

Additionally or alternatively, the computer 40 may notify the remote computer 50 of real-time decisions of a local operator. A remote operator with access to remote computer 50 may then take action in response to the reported real-time decisions of the local operator. For example, the remote operator may call the drilling rig directly, e-mail the drilling rig, or push an automated correction back to the control system based on a determination that one or more real-time decisions of the local operator has an error. In other words, some embodiments enable a remote override of local operator decisions. In such case, the local operator may receive notification of the override as well as related information.

In accordance with at least some embodiments, the remote computer system 50 that applies survey data corrections includes a processing unit 52 that executes software or instructions obtained from a local or remote non-transitory computer-readable medium 58. The computer system 50 also may include input device(s) 56 (e.g, a keyboard, mouse, touchpad, etc.) and output device(s) 54 (e.g., a monitor, printer, etc.). Such input device(s) 56 and/or output device(s) 54 provide a user interface that enables an operator to interact with software executed by the processing unit 52. For example, the computer system 50 may enable an operator to select survey correction options, to view survey correction results, to monitor alerts related to received survey data, to send corrected survey data to one or more drilling sites, to send alerts or drilling instructions to one or more drilling sites, to send override commands, along with the appropriate notification to a drilling site, andlor other operations.

In at least some embodiments, the remote computer system 50 may be, for example, part of a remote monitoring facility that is in communication with and receives survey data from many drilling sites. In such case, the remote computer system 50 may apply corrections to survey data based in part on multi-station analysis. For multi-station analysis, a model of sensor biases and offset errors is built based on analyzing a number of survey stations in the same well, where the data is acquired with sensors at different toolface orientations. These multiple surveys can be taken at one depth (typically referred to as a rotation shot), or at different depths. Curve fitting methods are sometimes used to determine and estimate the amount of bias and offset error present in the sensors. For more information regarding multi-site analysis, reference may be had to U.S. Pat. No. 5,806,194. Once corrections are applied, the corrected survey data is sent back from the remote monitoring facility to the respective drilling sites. At each drilling site a computer (e.g., the same or similar to computer system 40) receives the corrected survey data and automatically updates waypoints or a borehole path based on the corrected survey data. Once waypoints or a borehole path has been updated, drilling trajectory adjustments are performed manually or automatically.

In at least some embodiments, the corrected survey data or related alerts are sent by the remote computer system 50 to another computer system 60 such as a customer computer or one or mre survey expert computers. The computer system 60 includes a processing unit 62 that enables a customer to review corrected survey data or related alerts by executing software or instructions obtained from a local or remote non-transitory computer-readable medium 68. The computer system 60 also may include input device(s) 66 (e.g., a keyboard, mouse, touchpad, etc.) and output device(s) 64 (e.g., a monitor, printer, etc.). Such input device(s) 66 and/or output device(s) 64 provide a user interface that enables a customer to interact with software executed by the processing unit 62. In some embodiments, computer 60 corresponds to a mobile computing device such as a smart phone or tablet. For both desktop and mobile computing devices, the computer system 60 may enable a customer to review survey data, to review corrected survey data, to review a waypoint or borehole path, to review waypoint or borehole path updates, to review alerts/alarms, to reviewing drilling operations, andlor other operations. In some emboditnents, communications from computer system 60 may be sent to the computer system 40 or remote computer system 50 to update customer preferences or otherwise modify drilling project goals.

Figure 2:
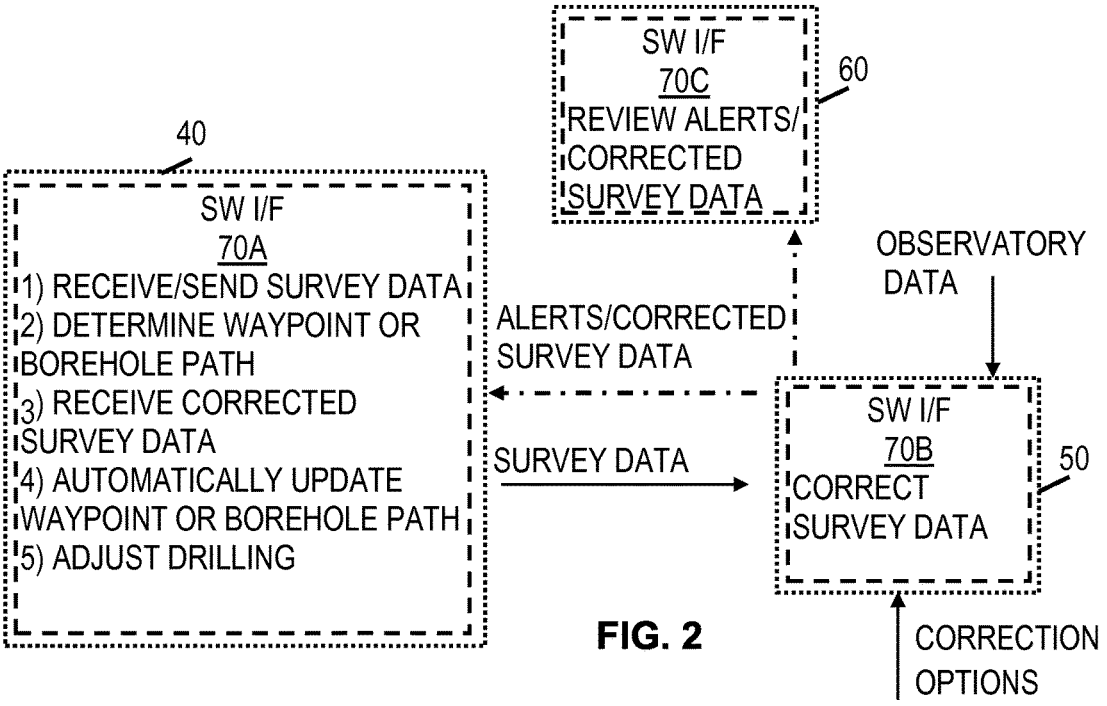
FIG. 2 is a block diagram showing illustrative software interface operations for the drilling system of FIG. 1.

FIG. 2 shows illustrative software interface operations for the drilling system of FIG. 1. In FIG. 2, the computer system 40 executes software interface 70A, the computer system 50 executes software interface 70B, and the computer system 60 executes software interface 70C. The software interfaces 70A-70C are intended to be compatible with each other to facilitate and expedite survey operations, survey data corrections, drilling operations, and customer review as described herein. For example, the software interfaces 70A-70C may employ a communication protocol, handshake, or session scheme that enables data to be exchanged between any of the software interfaces 70A-70C. Such a communication protocol, handshake, or session scheme enables the data received by any of the software interfaces 70A-70C to be interpreted and applied without user involvement. While user involvement is not required, each of the software interfaces 70A-70C typically provides a user interface that displays information to a user andlor that accepts user input.

In at least some embodiments, the software interface 70A receives survey data from a survey tool (e.g., survey tool 36) and determines a waypoint or borehole path based on the survey data. The waypoint or borehole path may be determined with or without involvement of a user. Before or after determining the waypoint or borehole path, the software interface 70A sends the survey data to software interface 70B. The software interface 70B applies corrections to the survey data received from software interface 70A based on observatory data and other correction options. In at least some embodiments, the software interface 70B applies corrections based in part on multi-station analysis and/or other processes. Further, the software interface 70B may provide a user interface that enables an analyst and/or survey manager to review survey data, to review proposed corrections, to modify correction schemes or results, and/or to otherwise correct survey data. In some embodiments, corrections are applied automatically, but if the survey data or the corrections fall outside a predetermine tolerance, an alert is sent to the analyst to review or update proposed corrections. Once the survey data has been corrected, the software interface 70B sends the corrected survey data to software interface 70A. Further, the software interface 70B may optionally send the corrected survey data to software interface 70C. The software interface 70C enables a customer (or anyone with license/permission to view the data) to review, for example, corrected survey data and related alerts. Further, the software interface 70C may enable a customer to submit project preferences or updates to software interfaces 70A or 70B. When the software interface 70A receives corrected survey data from software interface 70B, a waypoint or borehole path is automatically updated. Further, the software interface 70A may enable manual or automated drilling trajectory adjustments based on the updated waypoint or borehole path.

Figure 3:
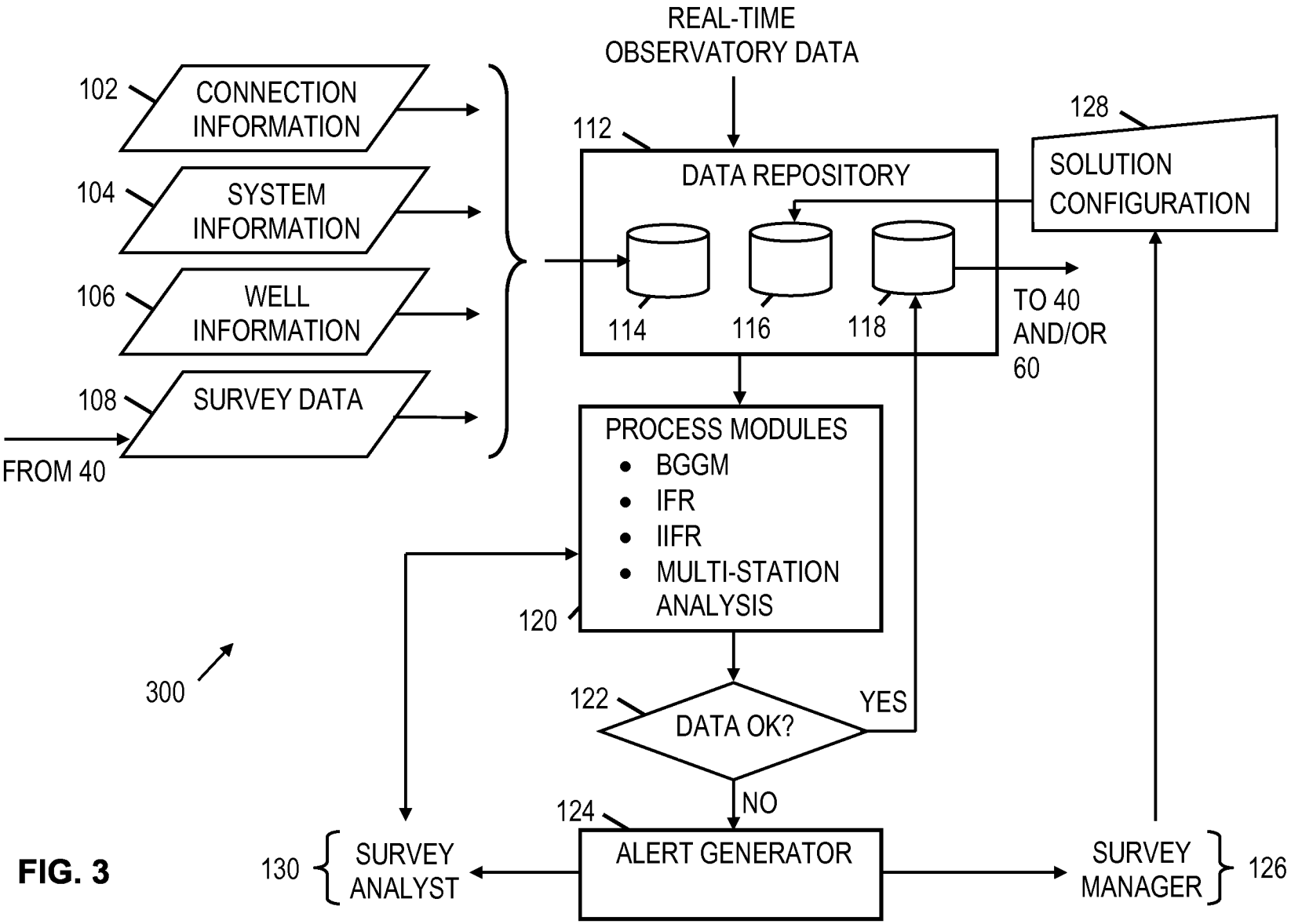
FIG. 3 is a process flow diagram showing an illustrative process for correcting survey data.

FIG. 3 shows an illustrative process flow 300. In at least some embodiments, the data repository 112, process modules 120, and alert generator 124 shown for process flow 300 correspond to components of computer system 50, software interface 70B, and/or other processing/storage options of a remote monitoring facility. In the process flow 300, the data repository 112 receives connection information 102, system information 104, well information 106, and survey data 108 as inputs. The connection information 102 may correspond to one or more database IP addresses, website connection information, and Geomagnetic Data Acquisition System (GDAS) connection information. The system information 104 may correspond to general options, processing options, quality control settings (tolerances), alarm intervals, proxy settings, user names, privileges, and contact information. The well information 106 may correspond to well data that is manually entered or retrieved from a database. Example well data includes, but is not limited to, units, north reference, coordinate system, magnetic model, calculation date, well name, country, district, job number, customer, company, rig, phone number, well elevation, map coordinates, and geographic coordinates. The survey data 108 corresponds to date/time, depth, $G_x$, $G_y$, $G_z$, $B_x$, $B_y$, $B_z$, tool azimuth, tool inclination, and/or other parameters received from a LWD or MWD tool (e.g, tool 22) via a drilling site computer such as computer system 40. Further, the survey data 108 may correspond to passive ranging data. For more information regarding passive ranging, reference may be had to U.S. Pat. No. 6,321,456.

In at least some embodiments, the survey data 108 corresponds to new survey data that is written to a field database as the survey data is collected by a survey tool (e.g., survey tool 36) and conveyed to a surface computer (e.g., computer 40) via known telemetry techniques. For example, such survey data 108 and other inputs may be transferred to database 114 of data repository 112. In some embodiments, the survey data is data-exchanged (DEX'd) from the field database to a server database (not shown) periodically or whenever changes to the field database are detected. The server database may store active survey data as well as historical survey data. The active survey data and/or historical survey data may be transferred from the server database to database 114 of data repository 112 periodically or as new data is received by the server database. In at least some embodiments, the data repository 112 may also import available third-party data (e.g., time/depth data survey data), which may be helpful for applying corrections to survey data as described herein.

The data repository 112 also receives real-time observatory data as input. For example, the real-time observatory data may correspond to British Geological Survey (BGS) data, Geomagnetic Data Acquisition System (GDAS) data, or local field monitoring system data. The BGS data corresponds to interpolated observatory data periodically retrieved from the BGS website or server. The GDAS data corresponds to data collected by one or more magnetic observatories around the world. One local magnetic observatory is located on the North Slope of Alaska and monitors the earth's magnetic disturbance variations for application to wells drilled on the North Slope. The GDAS data may be further corrected for secular variations (e.g, the BGS Global Geomagnetic Model (BGGM)) and crustal offsets variations. The GDAS monitoring service will eventually be replaced by BGS data. The local field monitoring system data corresponds to data obtained from a survey tool (e.g, survey tool 36) andlor Proton Precession Magnetometer (PPM) located in close vicinity to a borehole (e.g., borehole 16). The local field monitoring system monitors the disturbance variation at the borehole being drilled and applies the disturbance variation directly to the survey azimuth recorded by downhole sensors (e.g, sensors/receivers 38 of survey tool 36). Once the real-time observatory data is stored in the data repository 112, it becomes available to the survey processing threads represented by process modules 120.

In at least some embodiments, calibration correction may be applied to at least some of the real-time observatory data input to the data repository 112. For local field observatories, the observations recorded by a LWD or MWD sensor (e.g, sensors 38) need to be corrected for the attitude of the sensor and for the affects of temperature on the sensor readings. The attitude corrections are measured, for example, by positioning the sensor horizontally and pointing in the direction of magnetic east. Typical calibration techniques are well known in the industry. The local static dip value is obtained by simply recording the dip value on the sensor during a quiet period of magnetic activity. Further, the declination may be obtained, for example, by measuring the actual True North direction of the probe using a theodolite with GPS functionality. In an example calibration correction, a LWD or MWD tool (e.g., tool 36) may be placed in an oven (before deployment downhole) to determine sensor calibration parameters as a function of temperature. These calibration parameters may be stored in a database (e.g., database 114 or 116) and applied to update survey data in accordance with a recorded temperature that existed at the time the survey data was collected. Such calibration parameters may additionally or alternatively be loaded into the corresponding survey tool (e.g., survey tool 36) tool to enable improved survey data to be collected from its sensors (e.g., sensors/receivers 38).

In at least some embodiments, a crustal offset correction is applied to at least some of the real-time observatory data input to the data repository 112. The crustal offset correction is the accurate measurement of the static magnetic field at the rig site. It may be obtained either by taking field observations at the drilling site a survey tool (e.g., survey tool 36) or by performing an aeromagnetic survey that is subsequently used to create a model of the earth's crustal field in the vicinity of the drill location. Aeromagnetic surveys provide the ability to perform downward continuation corrections on the survey data as the well is drilled. These downward continuation corrections are the calculated values of the crustal field below the earth's surface thereby providing more accurate estimations of the crustal variations at each drilling site. Crustal variations remain static during the life of the drilling project and therefore only need to be performed once. When using the BGS service, crustal offset corrections are provided by BGS in the form of a Waypoint Definition File (WDF). The crustal offset corrections, when used, may be automatically applied to survey data. When GDAS data is monitored directly, crustal offset corrections may be entered and applied separately. In some embodiments, the real-time observatory data is written to observatory data tables by separate program threads, and the data tables are forward to data repository 112.

In at least some embodiments, the data repository 112 stores survey data, process parameters used by process modules 120, corrected survey data, and/or other information in one or more databases. For example, database 114 may store various types of data (e.g, survey data, observatory data, third-part data, etc.), database 116 stores process parameters, and database 118 stores corrected survey data so that every survey may be reprocessed using existing or modified parameters at a later date. More specifically, the database 114 may store data tables that contain exact copies of the original survey data and observatory data. Meanwhile, the database 116 stores process data tables containing all the information used to process the survey data including the observatory names and parameters, waypoint names and depths, run information, solution configuration information, etc. The process tables also contain information about the BGGM, IFR and IIFR parameters applied to each survey record as well as all of the multi-station analysis parameters. The database 118 stores corrected data tables containing a record of the corrected survey data transmitted back to each drilling site along with supplementary information that is used for post-analysis, reporting and plotting functions.

The process modules 120 perform the corrections to the observatory and survey data depending on the type of service being provided to the customer. In at least some embodiments, the process modules 120 perform various operations including detecting and retrieving new data from real-time observatory servers and appending the new data to the existing records in the data repository 112. Further, the process modules 120 may routinely monitor whether new data has been retrieved from real-time observatory servers and prepare the new data for processing. Further, the process modules 120 may record the time at which the new survey data is written to the data repository 112 so that process delays may be detected. Further, the process modules 120 may prepare new survey data for processing by searching the database for the associated process parameters (e.g., waypoints, solutions, etc.). Further, the process modules 120 may process new survey data by applying corrections and calculating the BGGM and IFR dip, $B_{total}$, declination values, long collar azimuth, and short collar azimuth. Further, the process modules 120 may search the corresponding observatory data associated with any unprocessed survey data and defer IIFR correction until the appropriate observatory data has been received. Further, the process modules 120 may apply the associated observatory data to the survey data if the IIFR service is provided. Further, the process modules 120 may perform multi-station analysis and corrections to the processed survey data. Further, the process modules 120 may determine whether the processed survey data falls within predetermined tolerances.

In at least some embodiments, the process modules 120 include a BGGM module that applies BGGM secular variation corrections to the survey data. Calculated BGGM corrections to be applied by the BGGM component may be compared with modeled BGGM corrections and checked against predefined tolerances. The process modules 120 also may include an IFR module that applies IFR corrections to survey data. Calculated IFR corrections to be applied by the IFR component may be compared with modeled IFR corrections and checked against predefined tolerances. The process modules 120 also may include an IIFR component applies IIFR corrections to survey data once corresponding observatory data becomes available. Calculated IIFR corrections to be applied by the IIFR component may be compared with modeled IIFR corrections and checked against predefined tolerances.

The process modules 120 also may include a multi-station analysis module that performs various operations. Further, the multi-station analysis module may analyze magnetometer sensor values and ensures that these values within predefined tolerances. If any of the measured or calculated values fall outside predefined tolerances (decision block 122), then a multi-stage alert sequence is initiated by alert generator 124. For example, the alert generator 124 may alert a survey analyst 130 with an audible and/or visual alarm. If a resolution has not been reached within a threshold amount of time, the alert generator 124 alerts the survey analyst 124 with a cell phone text message. If a resolution has not been reached within another threshold amount of time, the alert generator 124 alerts a survey manager 126 with a cell phone text message and email message. In at least some embodiments, operations of the process modules 120 can be monitored via a user interface. For example, a user interface may enable the survey analyst 124 to monitor the operations of the process modules 120 to ensure the operations are performed as expected. Further, the multi-station analysis module may enable the survey analyst 124 to modify solutions as needed via a user interface.

To summarize, the process modules 120 provide one or more user interfaces and identify any processes that fall outside of the predetermined tolerances. Further, the process modules 120 ensure that the received survey data is processed within a predefined time limit. Further, the process modules 120 trigger a sequence to transmit corrected survey data to each drilling site and waits for confirmation that the corrected survey data was received by the drilling site computer (e.g, computer system 40). Any surveys that fail the quality control tolerances are highlighted and examined by the survey analysis 124 and/or the survey manager 126. In at least some embodiments, the process modules 120 provide a user interface that enables the survey analysis 124 and/or the survey manager 126 to examine the existing data and to perform what-if scenarios. Once a new solution has been selected by the survey analysis 124 and/or the survey manager 126, the new solution is saved and applied to all new surveys. The operations performed by process modules 120 are repeated as needed.

While the operations of the process modules 120 may apply to many different surveys, it should be appreciated that some level of customization is possible. For example, each drilling project may be prepared by entering observatory information, well information 106, waypoint information and run information into the data repository 112 or databases thereof (e.g., databases 114 and 116). The operations of process modules 120 are dependent upon the solutions available, and each drilling project may be divided in one or more solutions depending on the profile of the well and the drilling environment. The solution configuration 128 controls which observatory is referenced, which waypoint is used and which services are processed. The solution configuration 128 also controls which BGGM, IFR, IIFR, multi-station analysis, and/or other parameters are used to correct survey data and as needed, the survey manager 126 may adjust the solution configuration 128.

Figure 4:
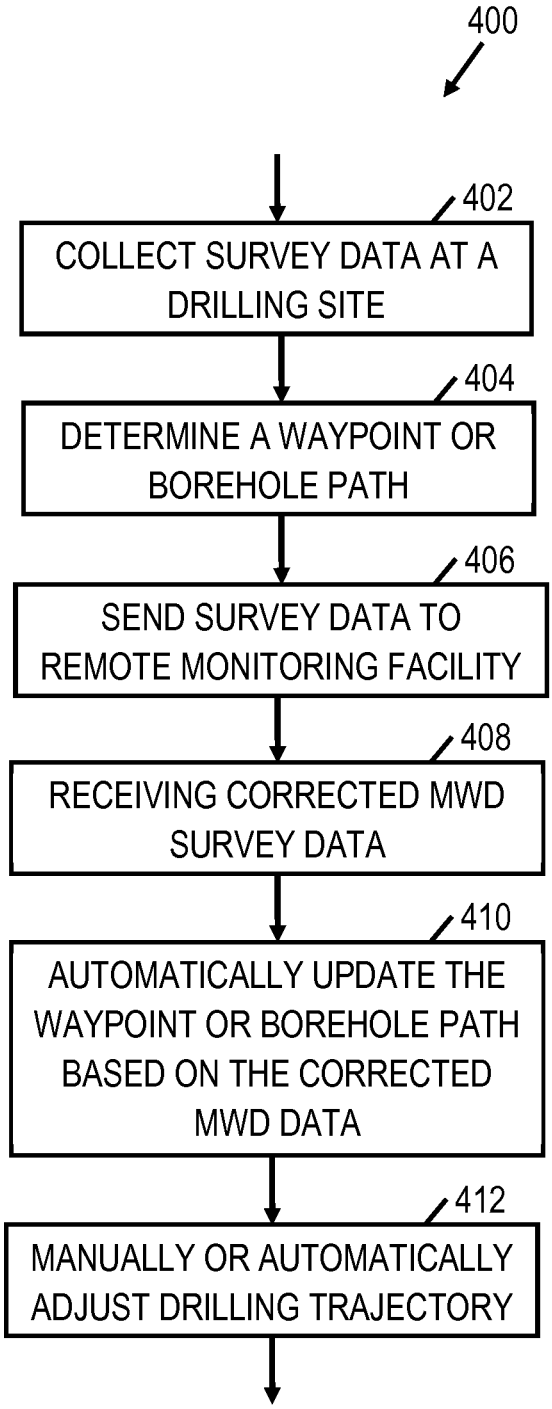
FIG. 4 is a flowchart showing an illustrative method for automating waypoint or borehole path updates based on survey data corrections.

FIG. 4 shows an illustrative drilling method 400. The method 400 may be performed, for example, by a drilling site computer such as computer system 40. In method 400, survey data is collected at a drilling site (block 402). At block 404, a waypoint or borehole path is determined based on the survey data. At block 406, the survey data is sent to a remote monitoring facility that applies corrections to the survey data. At block 408, the corrected survey data is received. At block 410, the waypoint or borehole path is automatically updated based on the corrected survey data. At block 412, a drilling trajectory is adjusted manually or automatically based at least in part on the updated waypoint or borehole path. Alternatively, if no corrections are needed (i.e., the survey data is within specified limits), blocks 408, 410, and 412 may be omitted. Instead, a notification to the effect that survey data corrections are not needed may be received. In such case, drilling adjustments are similarly not needed.

In at least some embodiments, the above-described methods and systems are also configured to improve well survey performance, for example, by linking errors identified by a central facility performing survey management (e.g., using multi-station analysis or other techniques) with an instrument performance model (IPM) of a well survey instrument (e.g., a sensor 38 of survey tool 36). For example, the remote computer system 50 may perform error analysis to identify errors associated with operating a well survey instrument in a magnetic environment (e.g., borehole 16). As described herein, the transfer of information between the computer system 40 and the remote computer system 50 for such error analysis may be automated (e.g., error analysis results or corrections can be provided with the alerts or corrected survey data described herein). The error analysis can identify, for example, multiple error sources of measured well survey data, errors (e.g., including error limits or ranges) of survey data due to the multiple error sources, reliability of any corrections to the survey data, or any other information. The error analysis results or correction information can be received from a remote computer system (e.g., remote computer system 50) and processed automatically by a drilling site computer system (e.g., computer system 40) as described herein to update a waypoint or borehole path for drilling operations, and/or to perform other operations.

In at least some embodiments, the errors can be determined for a specific well profile and location; and the error limits or quality control (QC) limits can vary as a function of wellbore location and attitude. For example, a sensitivity analysis can be performed to determine the accuracy with which cross-axial shielding and axial magnetic interference can be calculated for a well profile and location. The information identified by the error analysis can be linked to an IPM, for example, to select an appropriate IPM with technical specifications suitable for the identified errors, and to determine whether the selected IPM is correctly assigned. In this manner, an improved check on survey quality can be achieved.

In at least some embodiments, such error analysis can be applied to any borehole or well system where the survey information about the wellbore's position is derived from mutually orthogonal measurements of the instantaneous gravity and magnetic field vectors (e.g., with one of the measuring axes aligned along the principal or "hole" axis of the wellbore), and where an IPM is used to calculate the magnitude of positional uncertainty associated with these measurements. Such error analysis can be performed during a survey program design stage to determine (e.g., for each hole section) which error sources can reliably be calculated using single axis and multi-station analysis correction techniques. By linking the QC limits to an IPM used in the well planning stage, confidence that the survey lies within a calculated uncertainty region (e.g., an ellipse of uncertainty) can be improved. In at least some embodiments, the error analysis can also be used during a survey management stage (e.g., either during the data acquisition phase, with historical data, or a combination thereof) for each bit run as a quality check on the single axis calculated values of axial magnetic interference and the calculated values for cross-axial shielding and axial magnetic interference. In some instances, potential directional problems could be revealed during the planning stage. Linking the quality assurance (QA) checks to the IPM would provide a more reliable check on the required survey accuracy for each specific well.

Figure 5:
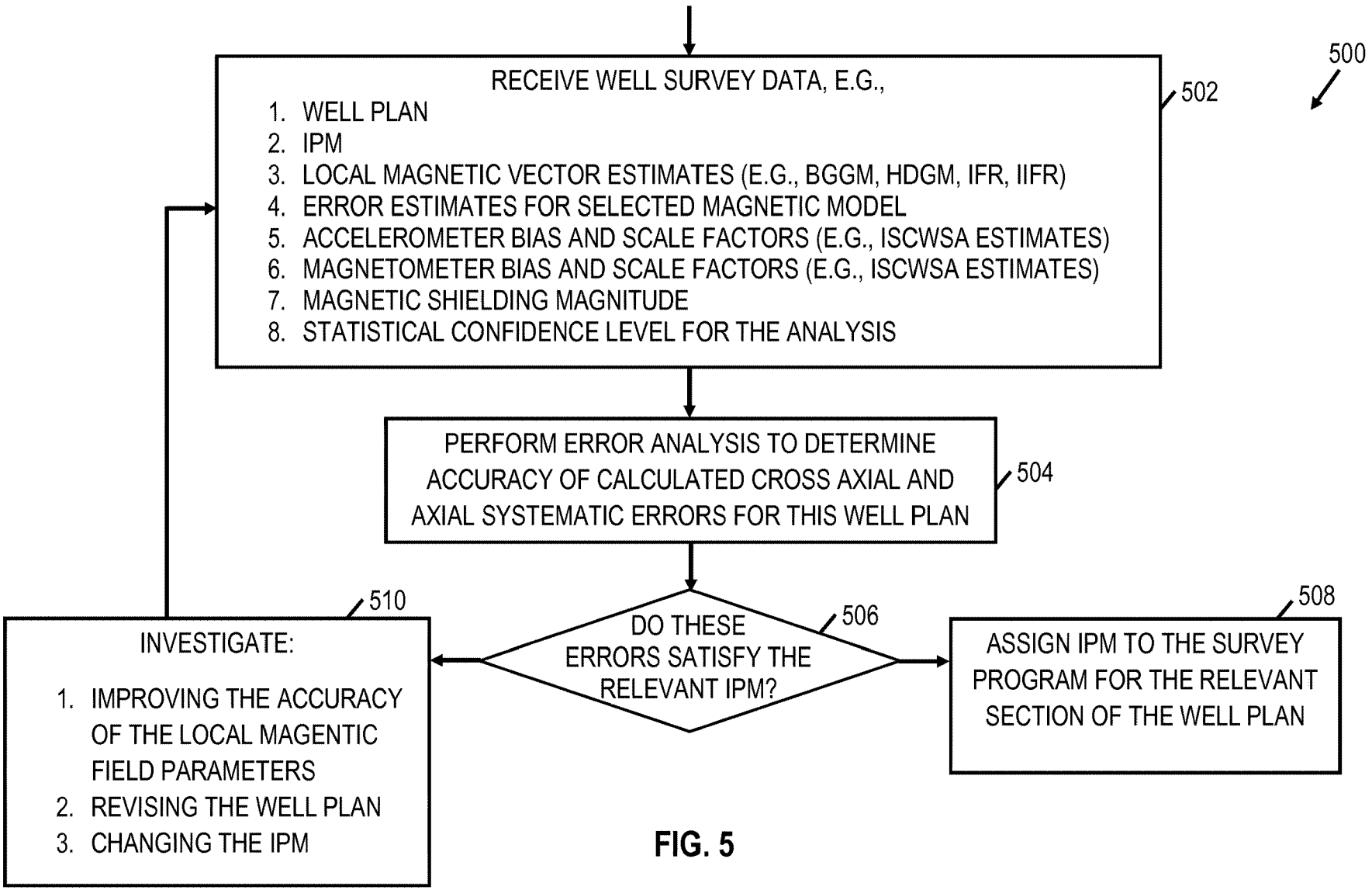
FIG. 5 is a flowchart showing an illustrative error analysis method for improving well survey performance.

FIG. 5 shows an error analysis method 500 for improving a well survey performance. As an example, the method 500 can be used to improve the survey performance of drilling system 100. All or part of the method 500 may be performed by computer system 50 and/or other computer systems of a remote facility. In at least some embodiments, some or all of the method 500 can be implemented and incorporated into MSA software or other module(s) of process modules 120 (see FIG. 3) to expand and enhance the capabilities of a central facility performing survey management. The method 500, individual operations of the method 500, or groups of operations may be iterated or performed in parallel, in series, or in another manner. In some cases, the method 500 may include the same, additional, fewer, or different operations performed in the same or a different order.

In some embodiments, some or all of the operations in the method 500 are executed during a survey program design or plan stage. Additionally or alternatively, some or all of the operations in the method 500 are executed in real-time during a survey management stage. For example, the operations of method 500 may be performed during a drilling process, or during another type of well system activity or phase in which measurement data is acquired and stored. In such case, the operations of method 500 can be performed in response to newly acquired data (e.g., from a sensor 38 of tool 36) without substantial delay. Further, the operations of method 500 can be performed in real-time while additional data is being collected (e.g., from surveying, drilling, or other activities). In at least some embodiments, operations of the method 500 involve receiving an input and producing an output during a treatment or other downhole operation, where the output is made available to a user (e.g., survey analyst 130) within a time frame that allows the user to respond to the output, for example, by modifying the survey program, the well plan, or another treatment.

At block 502, well survey data is received. The well survey data can include, for example, well plan data, one or more IPMs, and survey management data (e.g., data measured from a well survey instrument. The well survey data may additionally or alternatively include data processed by multi-station analysis software to account for a local magnetic environment at a wellbore location. Further, in at least some embodiments, the well survey data can include projected or hypothetical data, real-time data, historical data, or a combination thereof. Further, in at least some embodiments, some of the well survey data is time-dependent, location-dependent, or environment-dependent. For example, the well plan data, the IPM, and the measurement data can include data associated with different survey stations, drilling stages, wellbore locations, or subterranean environments. Further, additional or different data can be obtained and used for later processing.

The well plan data can include any data or information describes a well trajectory to be followed to take a well successfully from its surface position to the end of the well trajectory. For example, the well plan can include designed or projected wellbore location, depth, distance, inclination, azimuth, or other information that describe a wellbore position and attitude. Based on factors such as an expected use of a well (e.g., observation, production, injection, or multi-purpose well), parameters (e.g., production parameters, completion requirements, well dimensions, location), an expected life of the well, and conditions of the geological target (e.g., the subterranean reservoir) to be reached by the well, and other factors, the well plan can outline well objectives to be achieved during well drilling and well use.

The IPM (also called a toolcode) can include any information or modules that can be used to simulate a well surveying and planning tool or instrument. For example, an IPM can include a model simulating the performance of the survey tool and the way it was run and processed. In some instances, an IPM can include technical specifications of the survey accuracy, mathematical description of the expected errors, or any other information. For example, an IPM can include mathematical algorithms and constants for determining measurement uncertainty for a well survey instrument under specific downhole conditions. Further, the IPM can specify survey accuracy and provide a confidence indication of whether an actual well trajectory will match the predicted or planned trajectory (e.g., whether the actual wellbore location will hit the target location).

In at least some embodiments, the IPM can be specific to a particular survey instrument, a particular survey station, or a specific magnetic or gravitational environment. Further, a survey instrument may have multiple IPMs, for example, depending on the magnetic, gravitational or other subterranean environment to which the survey instrument is applied. Each IPM may describe how the survey instrument performs downhole in the corresponding subterranean environment. In some instances, IPM can be provided by instrument vendor, service company or operating company.

The well survey data may additionally or alternatively include local magnetic vector estimates, error estimates for selected magnetic model, accelerometer bias and scale factors, magnetometer bias and scale factors, magnetic shielding magnitude, statistical confidence levels for the analysis, residual errors from the thermal models and rotation check shot data obtained during the tool calibration process, or other information. In at least embodiments, local magnetic vector estimates is obtained from MWD Geomagnetic Models (e.g., BGGM, High Definition Geomagnetic Model (HDGM), IFR, or IIFR data). The accelerometer bias and scale factors (for accelerometers and magnetometer) are determined using routine calibration techniques. In at least some embodiments, errors associated with such bias and scale factors are within an error budget defined by the Industry Steering Committee on Wellbore Survey Accuracy (ISCWSA). However, it should be appreciated that survey management data can be obtained from additional or different models and techniques.

At block 504, an error analysis can be performed to identify errors associated with operating the well survey instrument in the magnetic environment at a wellbore location (e.g., borehole 16). In at least some embodiments, the error analysis can be performed based on the well survey data including, for example, well plan data and survey management data. Further, the errors associated with the well survey can be calculated for a particular well location, well attitude, accuracy of the local magnetic field parameters, or another factor. In some instances, the error analysis can include a sensitivity analysis to determine the accuracy of the calculated cross-axial and axial systematic errors for the well plan. As an example, limits of errors in the dip angle and the total magnetic field $B_{total}$ can be calculated as a function of well location, well attitude, and accuracy of the local magnetic field parameters. In some instances, the errors in dip and $B_{total}$ can be determined based on different error sources including, for example, axial magnetic interference, cross-axial magnetic shielding, errors from magnetometers and accelerometers, or other types of errors. In some embodiments, the errors in dip and $B_{total}$ can be determined from the following equations, or in another manner.

$$P = \cos\gamma * \sin\theta * \cos\psi + \sin\gamma * \cos\theta \quad (1)$$

$$Q = \cos\gamma * \cos\theta - \sin\gamma * \sin\theta * \cos\psi \quad (2)$$

LONG COLLAR AZIMUTH

Axial Magnetic Interference $$\delta Dip(\delta BZ) = \frac{Q}{Be} * \frac{180}{\pi} * \delta Bz \quad (3)$$

$$\delta Bt(\delta Bz) = P * \delta Bz \quad (4)$$

Cross-axial magnetic shielding $$\delta Dip(Sxy) = -P * Q * \frac{Sxy}{100} * \frac{180}{\pi} \quad (5)$$

$$\delta Bt(Sxy) = Be * (1 - P^2) * \frac{Sxy}{100} \quad (6)$$

Magnetometer Errors $$\delta Dip(\delta B_{xyz}) = \frac{\delta B_{xyz}}{Be} * \frac{180}{\pi} \quad (7)$$

$$\delta Bt(\delta B_{xyz}) = \delta B_{xyz} \quad (8)$$

Accelerometer Errors $$\delta Dip(\delta G_{xyz}) = \delta G_{xyz} * \frac{180}{\pi} \quad (9)$$

SHORT COLLAR AZIMUTH

-continued $$K = 1 - \sin^2\theta * \sin^2\psi \quad (10)$$

Theoretical Dipe Error $$\delta Dipc(\delta Be) = \frac{P * Q}{K * Be} * \delta Be * \frac{180}{\pi} \quad (11)$$

$$\delta Btc(\delta Be) = \left(\frac{P^2}{K} - 1\right) * \delta Be \quad (12)$$

Cross-axial shielding $$\delta Dipc(Sxy) = \frac{-P * Q}{K} * \frac{Sxy}{100} * \frac{180}{\pi} \quad (13)$$

$$\delta Btc(Sxy) = \left(1 - \frac{P^2}{K}\right) * Be * \frac{Sxy}{100} \quad (14)$$

Magnetometer errors $$\delta Dipc(\delta B_{xyz}) = \frac{P}{Be * \sqrt{K}} * \frac{180}{\pi} * \delta B_{xyz} \quad (15)$$

$$\delta Btc(\delta B_{xyz}) = \frac{Q}{\sqrt{K}} * \delta B_{xyz} \quad (16)$$

Accelerometer errors $$\delta Dipc(\delta G_{xyz}) \frac{P^2}{K} * \frac{180}{\pi} * \delta G_{xyz} \quad (17)$$

$$\delta Btc(\delta G_{xyz}) = \frac{Be * P * Q}{K} * \delta G_{xyz} \quad (18)$$

In the above equations, Be represents local magnetic field strength; γ represents local magnetic dip angle; Bn represents horizontal magnetic field; θ0 represents inclination; ψ represents magnetic azimuth; 67Dip represents calculated dip angle error; δBt represents calculated $B_{total}$ error; δDipc represents error in calculated dip angle using short collar correction (SCC) azimuth; δBtc represents error in calculated $B_{total}$ using SCC azimuth; δBz represents axial magnetic interference; $S_{xy}$ represents cross-axial magnetic shielding (%); $\delta B_{xyz}$ represents magnetometer errors; $\delta G_{xyz}$ represents accelerometer errors; δDipe represents error in local dip angle; and δBe represents error in local magnetic field. Additional or different errors of well survey parameters can be determined.

In at least some embodiments, the error limit can be determined based on the multiple errors calculated for different error sources, for example, by identifying the maximum error value among the multiple errors. Further, the error limit can vary as a function of wellbore location and attitude and can change for each survey station. Further, the error limit can be used as the quality control or quality assurance (QC or QA) metric and can be linked to a specific IPM to provide an improved check on survey quality. Further, an appropriate IPM for the well survey by the well survey instrument can be selected based on the error analysis. For example, the IPM can be selected such that the errors identified by the error analysis satisfy specifications of the IPM.

At decision block 506, a determination is made regarding whether the errors satisfy a selected IPM. In at least some embodiments, the determination can be based on a comparison between the error limit and a well survey accuracy specified by the IPM. The accuracy specification of the IPM can include, for example, a range (e.g., associated with a confidence interval), an upper limit, a lower limit, or another type of information indicating the expected accuracy (or uncertainty) of operating the well survey instrument in a subterranean environment. In some instances, if the errors satisfy the IPM (e.g., the error limit falls within an accuracy range specified by the IPM, the maximwn error is less than or equal to the upper uncertainty limit specified by the IPM, etc.), the IPM can be assigned to the survey program at block 508, for example, for the corresponding section of the well plan.

In at least some embodiments, if the errors do not satisfy the IPM (e.g., the maximum error calculated based on the error analysis of block 504 exceeds the accuracy specification of the IPM), techniques for manipulating or otherwise processing the well survey data can be performed to select an IPM such that the errors satisfies the IPM at block 510. Techniques for processing the well survey data can include, for example, improving the accuracy of the local magnetic field parameters or other survey parameters, revising the well plan, changing the IPM, or other techniques.

In at least some embodiments, the accuracy of the local magnetic field parameters can be improved, for example, by using more accurate and advanced survey instrument or survey management models and techniques. For instance, the local magnetic field parameters can be obtained from IIRF instead of BGGM since typically IIRF provides more accurate local magnetic field parameter values than BGGM. As another example, the errors of magnetometers and accelerometers can be reduced, for example, by using higher-quality magnetometers and accelerometers.

As needed, a well plan can be revised, for example, to change the well profile, waypoints, borehole path, or trajectory. For instance, a well plan can be changed to account for different gravitational or magnetic environments. As an example, gravity environments are generally consistent (changing as a function of depth) and can be accounted for using downward continuation modeling. Meanwhile, known magnetic or geological problems can be accounted for based on historical data.

Further, IPMs can be changed. For example, another IPM with a less stringent accuracy specification (e.g., with a lower confidence level or interval) can be selected no that the identified error limit fits within the accuracy specification of the new IPM. In some instances, an IPM with a more stringent accuracy specification (e.g., with a higher confidence level or interval) may be selected if the identified upper error limit is much lower than the accuracy specification of the current IPM. In this case, the errors associate with operating the survey instrument can be more tightly fitted into the accuracy specification of the IPM and the IPM can be more accurate in describing the performance of the survey instrument.

Additional or different techniques can be used for the method 500. For example, after performing one or more operations at block 510, the method 500 may return to block 502 based on a changed well plan, IPM, or other information. The method 500 may be performed in an iterative manner until, for example, an appropriate IPM is selected such that the errors associated with the well survey instrument are compatible with the IPM.

Embodiments disclosed herein include:

A: A drilling method that comprises collecting survey data at a drilling site, determining a waypoint or borehole path based on the survey data, sending the survey data to a remote monitoring facility that applies corrections to the survey data, receiving the corrected survey data, and automatically updating the waypoint or borehole path based on the corrected survey data or a related correction message.

B: A drilling system that comprises a survey tool that collects survey data. The system also comprises at least one drilling site computer configured to receive the survey data from the survey tool, to determine a waypoint or borehole path based on the survey data, and to send the survey data to a remote monitoring facility. The at least one drilling site computer is configured to automatically update the waypoint or borehole path based on corrected survey data or a related correction message received from the remote monitoring facility.

C: A system that comprises a first computer that determines a waypoint or borehole path based on survey data collected by a survey tool, and a second computer in communication with the first computer. The second computer applies a correction to the survey data based on at least one of observatory data, multi-station analysis, and an instrument performance model (IPM). The first computer automatically updates the waypoint or borehole path based on the corrected survey data or a related correction message.

Each of the embodiments, A, B, and C, may have one or more of the following additional elements in any conthination. Element 1: further comprising displaying an update acceptance prompt or alert notification related to the updated waypoint or borehole path. Element 2: the update acceptance prompt or alert notification includes at least some of the corrected survey data. Element 3: the update acceptance prompt or alert notification includes a plurality of response options. Element 4: further comprising displaying the updated waypoint or borehole path. Element 5: further comprising automatically adjusting a drilling trajectory based at least in part on the updated waypoint or borehole path. Element 6: further comprising manually adjusting a drilling trajectory based at least in part on the updated waypoint or borehole path. Element 7: the survey data comprises time, depth, inclination, and azimuth data, magnetic field components, and gravitational field components. Element 8: the survey data comprises passive ranging data. Element 9: the corrections to the survey data are based at least at least one of observatory data, multi-station analysis, and an instrument performance model (IPM). Element 10: the related correction message includes a survey tool replacement indicator.

Element 11: the at least one drilling site computer is configured to display an update acceptance prompt or alert notification related to the updated waypoint or borehole path. Element 12: the update acceptance prompt or alert notification includes a plurality of response options. Element 13: the at least one drilling site computer displays the updated waypoint or borehole path. Element 14: the at least one drilling site computer provides a drilling control interface that enables a drilling trajectory to be automatically adjusted based at least in part on the updated waypoint or borehole path. Element 15: the at least one drilling site computer provides a drilling control interface that enables a drilling trajectory to be manually adjusted based at least in part on the updated waypoint or borehole path. Element 16: the survey data comprises magnetic field components and gravitational field components. Element 17: further comprising at least one computer at the remote monitoring facility configured to apply at least one of a BGGM correction, an IFR correction, an IIFR correction, and an instrument performance model (IPM) correction to the survey data. Element 18: further comprising at least one computer at the remote monitoring facility configured to apply a correction to the survey data based on multi-station analysis.

Element 19: further comprising a third computer in communication with the second computer, wherein the third computer receives alerts related to the corrected survey data.

Element 20: the third computer comprises a mobile computing device.

Nutnerous variations and modifications will become apparent to those skilled in the art once the above disclosure is fully appreciated. For example, it should be appreciated that corrected survey data may be sent from a remote monitoring facility to drilling site computer and/or customer computers in an automated manner once corrections are approved/applied. It is intended that the following claims be interpreted to embrace all such variations and modifications.

What is claimed is:

1. A drilling method that comprises:

collecting survey data at a drilling site using a survey tool;

determining a waypoint or borehole path based on the survey data;

upon said collecting, automatically sending the survey data to a remote monitoring facility that automatically applies a correction to the survey data if the survey data is within a predetermined tolerance, and generates a first alert to a survey analyst if the survey data is outside of the predetermined tolerance;

receiving from the remote monitoring facility the corrected survey data or a related correction message;

upon said receiving the corrected survey data or the related correction message, automatically updating the waypoint or borehole path based on the corrected survey data or the related correction message; and automatically adjusting a drilling trajectory based at least in part on the updated waypoint or borehole path.

2. The method of claim 1, further comprising displaying an update acceptance prompt or alert notification related to the updated waypoint or borehole path.

3. The method of claim 1, wherein if the survey data is not corrected within a threshold amount of time after the first alert has been generated, a subsequent alert is generated to a survey manager.

4. The method of claim 2, wherein the update acceptance prompt or alert notification includes a plurality of response options.

5. The method of claim 1, further comprising displaying the updated waypoint or borehole path.

6. The method of claim 1, wherein an operator of the drilling site modifies the automatically adjusted drilling trajectory.

7. The method of claim 1, wherein said adjusting includes manually adjusting the drilling trajectory based at least in part on the updated waypoint or borehole path.

8. The method of claim 1, wherein the survey data comprises time, depth, inclination, and azimuth data, magnetic field components, and gravitational field components.

9. The method of claim 1, wherein the survey data comprises passive ranging data.

10. The method of claim 1, wherein the correction to the survey data is based further on observatory data or multi-station analysis.

11. The method of claim 1, wherein a survey tool replacement indicator is automatically included to the related correction message when a quality of the survey data is below a threshold.

12. A drilling system that comprises:

a survey tool that collects survey data at a drilling site; and at least one drilling site computer that:

receives the survey data from the survey tool, to determine a waypoint or borehole path based on the survey data;

upon receiving the survey data, automatically sends the survey data to a remote monitoring facility that automatically applies a correction to the survey data if the survey data is within a predetermined tolerance and generates a first alert to a survey analyst if the survey data is outside of the predetermined tolerance; and automatically updates, upon receiving corrected survey data or a related correction message from the remote monitoring facility, the waypoint or borehole path based on the corrected survey data or the related correction message;

wherein the at least one drilling site computer provides a drilling control interface that enables a drilling trajectory to be adjusted based at least in part on the updated waypoint or borehole path.

13. The system of claim 12, wherein the at least one drilling site computer displays an update acceptance prompt or alert notification related to the updated waypoint or borehole path.

14. The system of claim 13, wherein the at least one drilling site computer allows an operator of the drilling site to modify the automatically adjusted drilling trajectory.

15. The system of claim 12, wherein if the survey data is not corrected within a threshold amount of time after the first alert has been generated, a subsequent alert is generated to a survey manager.

16. The system of claim 12, wherein the drilling trajectory is automatically adjusted based at least in part on the updated waypoint or borehole path.

17. The system of claim 12, wherein the drilling trajectory is manually adjusted based at least in part on the updated waypoint or borehole path.

18. The system of claim 12, wherein the survey data comprises magnetic field components and gravitational field components.

19. The system of claim 12, further comprising at least one computer at the remote monitoring facility that applies at least one of a BGGM correction, an IFR correction or an IIFR correction to the survey data.

20. The system of claim 12, further comprising at least one computer at the remote monitoring facility that applies the correction to the survey data.

21. A system that comprises:

a first computer that determines a waypoint or borehole path based on survey data collected by a survey tool; and a second computer of a remote monitoring facility in communication with the first computer, wherein the second computer automatically applies a correction to the survey data if the survey data is within a predetermined tolerance and generates a first alert to a survey analyst if the corrected survey data is outside of the predetermined tolerance;

wherein the first computer automatically sends the survey data to the remote monitoring facility, automatically updates the waypoint or borehole path based on the corrected survey data or a related correction message received from the remote monitoring facility, and enables a drilling trajectory to be adjusted based at least in part on the updated waypoint or borehole path.

22. The system of claim 21, further comprising a third computer in communication with the second computer, wherein the third computer receives alerts related to the corrected survey data.

23. The system of claim 22, wherein the third computer comprises a mobile computing device.

* * * * *